US005299503A

United States Patent [19]

Frehaut et al.

[11] Patent Number: 5,299,503

[45] Date of Patent: Apr. 5, 1994

[54] SHELL WHOSE BASE SERVES AS THE PARACHUTE CAN OF A SUBMUNITION

[75] Inventors: Jean-Pierre Frehaut, Versailles; Pascal Laurend, Jouy le Potier, both of France

[73] Assignee: Thomson-Brandt Armements, La Ferte Saint Aubin, France

[21] Appl. No.: 973,732

[22] Filed: Nov. 9, 1992

[30] Foreign Application Priority Data

Dec. 10, 1991 [FR] France ..... 91 15268

[51] Int. Cl.[5] ..... F42B 12/58; F42B 10/56

[52] U.S. Cl. ..... 102/489; 102/357

[58] Field of Search ..... 102/483, 393, 357, 386, 102/387, 388, 339, 340, 348, 351

[56] References Cited

U.S. PATENT DOCUMENTS

| | | | |
|---|---|---|---|
| 4,023,495 | 5/1977 | Fischer et al. | 102/340 |
| 4,498,393 | 2/1985 | Fischer et al. | 102/393 |
| 4,854,241 | 8/1989 | Synofzik et al. | 102/489 |
| 4,856,432 | 8/1989 | Synofzik | 102/489 |
| 4,920,887 | 5/1990 | Frehaut et al. | 102/489 |
| 5,003,882 | 4/1991 | Frehaut et al. | 102/387 |
| 5,016,839 | 5/1991 | Frehaut et al. | 244/147 |
| 5,054,400 | 10/1991 | Pineau et al. | 102/489 |
| 5,107,768 | 4/1992 | Langenohl | 102/489 |
| 5,111,748 | 5/1992 | Thurner et al. | 102/387 |
| 5,140,909 | 8/1992 | Pineau et al. | 102/489 |

FOREIGN PATENT DOCUMENTS

| | | | |
|---|---|---|---|
| 0395456 | 10/1990 | European Pat. Off. . | |
| 3635361 | 4/1988 | Fed. Rep. of Germany . | |
| 3743840 | 7/1989 | Fed. Rep. of Germany . | |
| 2363077 | 3/1978 | France . | |
| 1545148 | 5/1979 | United Kingdom | 102/489 |

*Primary Examiner*—David H. Brown

*Attorney, Agent, or Firm*—Oblon, Spivak, McClelland, Maier & Neustadt

[57] ABSTRACT

The invention relates to a shell, the base of which acts as the parachute can of a sub-munition. The shell contains sub-munitions stacked one behind the other and is closed at the rear by a base. The submunitions are each equipped with a parachute and a can containing the folded parachute, the separation of each sub-munition from its can permitting the deployment of the parachute. The can of the sub-munition situated at the rear of the shell is constituted by the base of the shell.

5 Claims, 1 Drawing Sheet

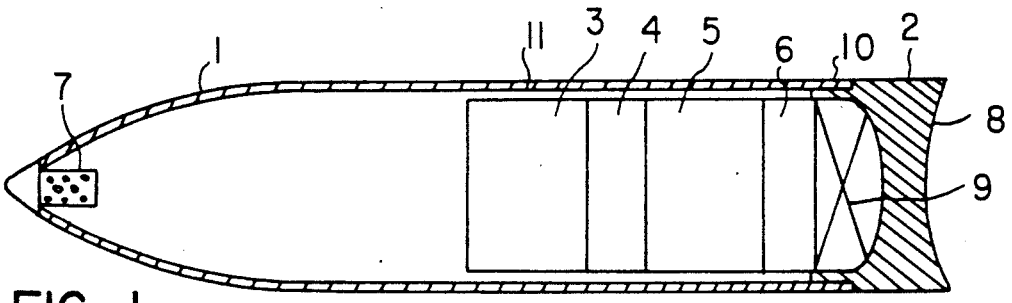
FIG. 1
(PRIOR ART)
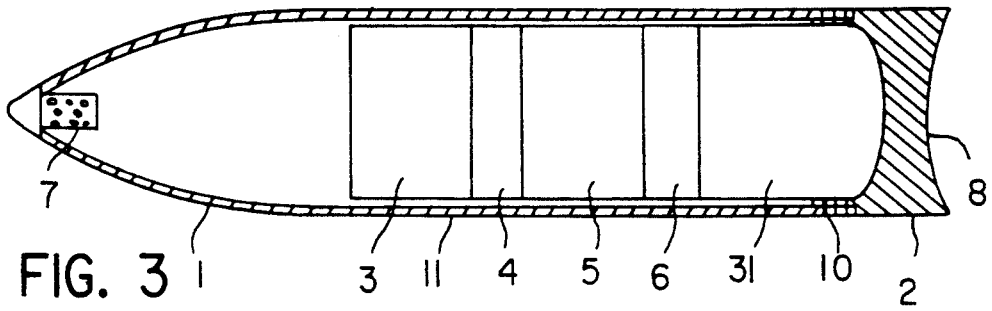
FIG. 3
FIG. 2
(PRIOR ART)
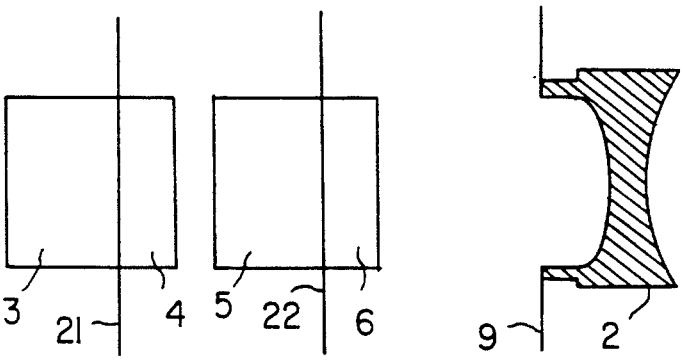
FIG. 4
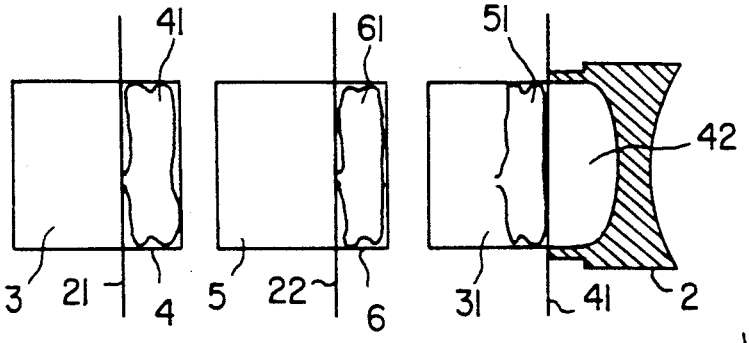
FIG. 5
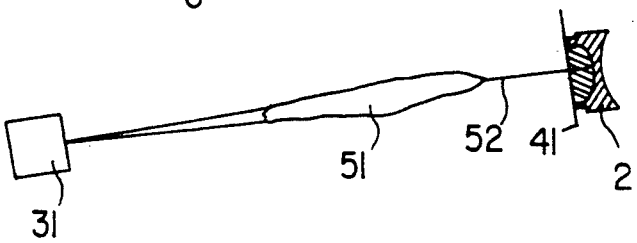

SHELL WHOSE BASE SERVES AS THE PARACHUTE CAN OF A SUBMUNITION

BACKGROUND OF THE INVENTION

The present invention concerns a cargo shell, the base of which acts as the parachute can of a sub-munition. It applies notably to shells containing sub-munitions equipped with parachutes and destined to be released by these shells.

Certain shells can contain several sub-munitions stacked one on top of the other. These sub-munitions are generally equipped with a parachute braking their fall towards the ground. Each sub-munition is therefore equipped at the rear with a container or can containing the folded parachute. The sub-munitions ejected from the shell by its rear following the combustion of a chronometrically controlled pyrometric ejection charge at the front of the shell. Even though they are ejected out of the rear of the shell, the sub-munitions nevertheless continue their course along the trajectory of the shell at the time of the ejection. At this moment, the sub-munitions remain stacked as they were in the shell. Having been ejected from the rear, which contributes advantageously to slowing them down, it follows that the base of the shell accompanies them in their flight, still located behind them. In general, before the opening of their parachutes, the sub-munitions must be slowed down. For this purpose, they each possess their own braking means, a small parachute or flexible, laterally deploying flaps, for example. These sub-munitions can be equipped with fragile components, notably sensors, sensitive to mechanical shocks. It is therefore necessary, that the sub-munitions do not collide with each other during the braking phase. In particular the base must be braked more strongly than the sub-munitions so that it doesn't strike them. This makes it necessary to equip it with braking means, more powerful than those of the sub-munitions, which are therefore relatively cumbersome.

In order to increase shells' efficiencies, it is desirable to increase the number of sub-munitions that they contain. The shell dimensions being imposed and standardized, it is necessary to try to optimize their internal layout. In particular, the internal space available is in part reduced by the means of braking the shell's base which can limit the number of sub-munitions contained in it.

The purpose of the invention is to overcome these disadvantages.

SUMMARY OF THE INVENTION

To this end, the invention concerns a shell containing sub-munitions stacked one behind the other and closed at the rear by a base, each sub-munitions being equipped at its rear with a parachute, and a can containing the folded parachute, the separation of each sub-munition from its can permitting the deployment of its parachute, wherein the can of the sub-munition situated at the rear of the shell consists of the shell base, attached to the aforementioned sub-munition after its ejection from the shell.

The principle advantages of the invention are that it increases the available space inside the shell, that it eliminates the risk of collisions between the sub-munitions and the shell base, and finally that it reduces the number of components and therefore the cost of the shell.

BRIEF DESCRIPTION OF THE DRAWINGS

Other characteristics and advantages of the invention will appear with the aid of the following description which refers to the appended drawings which represent:

FIG. 1, a shell containing sub-munitions according to the prior art;

FIG. 2, an illustration of the flight of the sub-munitions and the shell base after their ejection from the shell;

FIG. 3, a possible example of a shell containing sub-munitions according to the invention;

FIG. 4, an illustration of the flight of the sub-munitions and the shell base after their ejection from the shell according to the invention;

FIG. 5, an illustration of the deployment of the parachute of the sub-munition situated at the rear of the shell according to the invention.

In all these figures, the shell base and the shell casing are shown :n cross-section.

DESCRIPTION OF THE INVENTION

FIG. 1 represents a shell 1, having a casing 1 and containing the ejection means 7 and sub-munitions 3 and 5. The shell 1 is closed by the base 2 as per the prior art.

The sub-munitions 3 and 5 are equipped at their rear with parachutes contained in the can 4 and 6, closed by the sub-munitions. The base 2 is capable of withstanding very high pressures on its external face 8, notably at the moment of its firing by a cannon; these pressures can, for example, reach 4000 bars. The base 2 also comprises the braking means 9, not deployed while it is attached to the shell 1. The base 2 is, for example, screwed on to the shell so as to keep it attached to it. The sub-munitions are ejected following the combustion of a gas generator 7, for example, situated at the front of the shell. This combustion is triggered after a pre-determined delay using a chronometric fuse for example. The pressure pushes the sub-munitions 3 and 5, towards the rear of the shell 1, the thrust being sufficiently strong to free the base 2 from the shell 1 by breaking the means 10 retaining the base 2 on the shell 1, these retaining means 10 being a screwthread for example, used to screw the base onto the shell 1. The sub-munitions 3 and 5, ejected from the rear of the shell 1, nevertheless, continue their course in the same direction and at the same angle as the shell, but with a lower speed as a result of the rearward thrust to which they have been subjected. The base 2 has the same speed as the sub-munitions 3 and 5 and therefore accompanies them in their flight.

FIG. 2 illustrates the relative position of the sub-munitions 3 and 5 and the base 2 after their ejection from the shell 1. The sub-munitions 3 and 5 are still equipped with their cans 4 and 6 so as to protect the parachutes and keep them folded. The braking means 21 and 22, flaps for example are deployed so as to reduce the speed of the sub-munitions 3 and 5. The braking means 9 of the base 2 slow this down as well and must act in such a way that the base does not collide with the sub-munition 5 situated directly in front of it. To avoid any risk of collision, it must be slowed down more than the sub-munitions 3 and 5. It follows that these braking means 9 must be powerful and therefore voluminous. If they consist of flaps for example, these must have a surface area greater than the sub-munitions, flaps, so as to present a larger drag and increase the braking effect. This surface area must be even larger because of the fact that the flaps of base 2 being close to those of the sub-munition 5 are, in part, masked by the latter. The braking means 9 of base 2 are therefore bulky and waste space inside the shell 1.

FIG. 3 represents a possible physical embodiment of the shell 1 according to the invention. The shell contains ejection means 7, a gas generator for example, and sub-munitions 3 and 5, identical to those in the preceding figures. It contains at the rear a sub-munition 31, the body of which is identical to the bodies of the other sub-munitions 3 and 5 but the can of which, containing its parachute, :s made up of the base 2 of the shell 1. The base 2 while being attached to sub-munition 31 is also attached to the shell 1 by the attachment means 10, a screw-thread for example, permitting it to screw onto the shell. The base 2 can also be fastened to the shell 1 with screws and pins susceptible to shearing, a technique known to specialists.

The sub-munition 31 is fastened to the base 2 using screws for example.

The sub-munitions 3, 5 and 31 are ejected from the shell 1 by its rear as has been previously described, that is to say following the combustion of the gas generator 7 at the front of the shell 1 and following the destructions of the means 10 of holding the base 2 on the shell 1.

FIG. 4 represents the sub-munitions 3, 5 and 31 after their ejection from the shell 1, continuing their flight along the same trajectory as the shell. The parachutes 41, 51, 61 not being deployed yet, the cans 4, 6 and 2 are still attached to the sub-munitions 3, 5 and 31. The parachute can of the sub-munition 31 which was situated at the rear of the shell 1 is in fact the base of this shell 1. This contains in its interior 42 the parachute of the sub-munition 31.

The base 2 being attached to the sub-munition 31, it no longer risks colliding with it.

The braking means 41 of the sub-munition 31, similar to those (21 and 22) of the other sub-munitions 3 and 5, are activated. The braking means 41 can be, for example, deployed flaps. Having had to withstand high pressures at the time of firing the shell 1 from a cannon, the base 2 acting as the parachute can for the sub-munition 31 is necessarily more resistant and therefore heavier than the other cans 4 and 6 of the sub-munitions 3 and 5. As a result, the braking means 41 of the sub-munition 31 are more powerful than those of the other sub-munitions 3 and 5.

If the braking means consist of flaps, these would, for example, have to be more numerous.

Nevertheless, the braking means 41 being common to the sub-munition 31 and the base 2, the braking of the base no longer results in wasted space inside the shell 1, because the braking means are shared between the sub-munition 31 and the base 2. On the contrary, the shell base according to the invention, acting as a parachute can permits the increase of the number of sub-munitions inside the shell.

FIG. 5 illustrates the deployment of the parachute 51 of the sub-munition 31 by the separation of the can or base 2 from the latter. This separation can be triggered by a pre-set delay, for example. The means of attaching to and separation from the sub-munition 31 of the base 2 are identical to those of the other sub-munitions 3 and 5, the means of separation can be, for example, pyrotechnic means. To permit the deployment of the parachute 51, it is attached at one of its ends to a string 52, itself attached to the base 2. As a result of the drag force of the base 2, oriented in the opposite direction to the velocity of the sub-munition 31, the string 52 breaks when the parachute is completely unfolded.

The example of a shell, according to the invention, represented by FIG. 3, contains three sub-munitions, is given by way of example and can differ depending notably on the length of the shell or of the sub-munitions, or depending on other parameters.

What is claimed is:

1. Shell containing sub-munitions stacked one behind the other and closed at the rear by a base, each sub-munitions being equipped at its rear with a parachute and a can containing the folded parachute, the separation of each sub-munition from its can permitting the deployment of the parachute, wherein the can of the sub-munition situated at the rear of the shell consists of the shell base, attached to the aforementioned sub-munition after its ejection from the shell.

2. Shell according to claim 1, wherein the base is screwed onto the shell.

3. Shell according to claim 1, wherein one end of the parachute of the sub-munition situated at the rear of the shell is attached to a string, said string being, in turned attached to the base, wherein the strength of the string is less than the force exerted when said parachute is substantially deployed to thereby break said string and effect separation of said base from said parachute.

4. Shell according to claim 1, wherein said sub-munitions include braking means to slow their flight after their ejection from the shell.

5. Shell according to claim 4, wherein the braking means consist of flaps deploying after the ejection of the sub-munitions from the shell.

* * * * *